US005829300A

United States Patent [19]

Sova

[11] Patent Number: 5,829,300

[45] **Date of Patent: *Nov. 3, 1998**

[54] APPARATUS FOR TRANSFERRING AND FORMING PARTS IN A PRESS

[76] Inventor: Lester J. Sova, 22001 31 Mile Rd., Ray, Mich. 48096

[ * ] Notice: The term of this patent shall not extend beyond the expiration date of Pat. No. 5,359,875.

[21] Appl. No.: 714,220

[22] Filed: Sep. 16, 1996

Related U.S. Application Data

[62] Division of Ser. No. 332,247, Oct. 31, 1994, Pat. No. 5,598,733, which is a continuation of Ser. No. 62,842, May 14, 1993, Pat. No. 5,359,875.

[51] Int. Cl.[6] ..... B21D 43/05; B21D 43/10

[52] U.S. Cl. ..... 72/336; 72/339; 72/405.07; 198/426; 198/468.2; 83/404

[58] Field of Search ..... 72/336, 339, 329, 72/337, 330, 361, 405.06, 405.12, 405.13, 405.01; 198/426, 429, 430, 431, 468.2, 621.1; 83/404, 404.4, 405

[56] References Cited

U.S. PATENT DOCUMENTS

| | | | |
|---|---|---|---|
| 768,876 | 8/1904 | Campbell | 72/336 |
| 1,996,819 | 4/1935 | Dean | 72/405 |
| 2,900,072 | 9/1959 | Tully | 198/621 |
| 2,933,180 | 4/1960 | Dixon | 198/621 |
| 3,470,725 | 10/1969 | Brown | 72/336 |
| 3,897,869 | 8/1975 | Michael | 72/405 |
| 4,127,023 | 11/1978 | Jensen | 72/405 |
| 4,139,089 | 2/1979 | Jensen | 198/621 |
| 4,404,837 | 9/1983 | Allen | 72/405 |
| 4,567,746 | 2/1986 | Bachmann | 72/336 |
| 4,651,866 | 3/1987 | Imanishi | 72/405 |
| 4,977,772 | 12/1990 | Bulso | 72/336 |
| 5,001,921 | 3/1991 | Schneider | 72/405 |

FOREIGN PATENT DOCUMENTS

| | | | |
|---|---|---|---|
| 2659686 | 7/1978 | Germany | 72/405 |
| 774724 | 11/1980 | U.S.S.R. | 72/405 |
| 1230727 | 5/1986 | U.S.S.R. | 72/405 |

OTHER PUBLICATIONS

Victor M. Cassidy, "Appliance Makers Save Big With Automated Parts Transfer", HMS Products (Troy, Mich.), from Modern Metals, Mar., 1990.

*Primary Examiner*—Daniel C. Crane
*Attorney, Agent, or Firm*—Brooks & Kushman P.C.

[57] ABSTRACT

The present invention includes an apparatus and a method for transferring and forming parts in a press (20). The press (20) has a plurality of longitudinally dispose workstations (W). A parts transfer system (22) has a grasping unit (69) for releasably grasping or holding matrices (M) of workpieces (WP) and is mounted upon a translation base (68) which is movable between workstations (W). The press (20) simultaneously stamps and forms at least a pair of matrices (M) of workpieces (WP) in a single stroke of the press (20) and the parts transfer system (22) grasps and transfers the matrices (M) of workpieces (WP) between workstations (W). Each matrix has at least two longitudinal spaced columns and two laterally spaced rows of workpieces (WP). Preferably, the grasping unit (69) include matrices of gear boxes (110), interconnected by connecting rods (198), which pivotally support arms (140) and finger assemblies (146) which releasably grasp the workpieces (WP) . Ideally, the workpieces (WP) are stamped from a sheet material (24) in one of the workstations (W), pass through respective chutes (96) and are arranged into a matrix configuration. The method includes steps of transferring and forming matrices (M) of workpieces (WP) passing through a plurality of workstations W of press (20).

6 Claims, 8 Drawing Sheets

APPARATUS FOR TRANSFERRING AND FORMING PARTS IN A PRESS

This is a divisional of application(s) Ser. No. 08/332,247 filed Oct. 31, 1994 062,842, entitled "Apparatus And Method Method For Transferring And Forming Parts In a Press", now U.S. Pat. No. 5,598,733, which is a continuation of Ser. No. 08/062,842, filed May 14, 1993, entitled "Apparatus and Method For Transferring and Forming Parts In A Press", now U.S. Pat. No. 5,359,875.

TECHNICAL FIELD

The present invention relates to parts transfer systems which move workpieces through presses with the workpieces being progressively formed.

BACKGROUND ART

Parts transfer systems for transferring workpieces through a press as the workpieces are progressively formed typically move only a single part, or else, move a row of parts between adjacent workstations in the press. Therefore, the number of workpieces which can be operated upon in a single press stroke is limited. Accordingly, so is the number of finished parts which can be produced by a single press in a given time period.

An example of a parts transfer system wherein parts are moved row by row in a press is shown in U.S. Pat. No. 4,139,089 to Jensen. This particular parts transfer system is not well suited for high volume production.

Another shortcoming of conventional parts transfer systems is that they do not have mechanisms for stamping workpieces from a sheet of steel and then automatically positioning the workpieces in the parts transfer system.

DISCLOSURE OF INVENTION

The present invention includes an apparatus and a method for transferring and forming parts in a press. The press has a plurality of workstations including at least a pair of stamping workstations. Each workstation has a set of cooperating upper and lower dies having matrices of punches and cavities which move into and out of registration with one another during a stroke of the press to stamp and form a matrix of workpieces located in that stamping workstation. The matrices of punches, cavities and workpieces are identical in size and have at least two longitudinally spaced columns and at least two laterally spaced rows. Accordingly, the term matrix, for the purposes of this application, is defined as a configuration having n rows and m columns wherein n and m are equal to or greater than 2.

The parts transfer system has a grasping unit for releasably grasping workpieces. The grasping unit is mounted upon a translation base which is movable between workstations to transfer matrices of workpieces from upstream workstations to downstream workstations. The press simultaneously stamps and forms at least a pair of matrices of workpieces in a single stroke of the press and the parts transfer system grasps and transfers the matrices of workpieces between workstations between strokes of the press.

Preferably, the press has one workstation which stamps a plurality of workpieces from a coil or roll of sheet material. Ideally, a plurality of chutes receive the plurality of workpieces stamped from the sheet material and arrange the stamped workpieces into a matrix configuration of workpieces which can be releasably held by the grasping unit.

The grasping unit may include matrices of riser units interspersed among the matrices of punches or cavities of the lower dies. Each riser unit preferably has a gearbox with screw supporting an arm with at least one finger assembly thereon. The finger assemblies may be pivoted into and out of engagement with the workpieces to grasp the workpieces. The matrices of riser units are interconnected by connecting rods so that the finger assemblies grasp and release the workpieces in unison. The riser units are mounted upon the translation base which moves between workstations between strokes of the press to transfer the workpieces.

This invention also includes a method for transferring and progressively forming a plurality of matrices of workpieces passing through a press. Matrices of workpieces are placed into respective workstations of a press between sets of cooperating upper and lower dies having matrices of punches and cavities. The press is stroked to form the matrices of workpieces. The matrices of workpieces are then grasped and transferred to another workstation. The press is then stroked again further forming the matrices of workpieces. Consequently, a matrix of finished workpieces is produced with each stroke of the press.

Ideally this method includes a step of stamping a plurality of workpieces or blanks from a sheet of material and passing the workpieces through respective chutes to arrange the workpieces into a matrix configuration. Preferably, the step of grasping and transferring the matrices of workpieces includes providing matrices of riser units mounted upon a translation base which is translatable between workstations of the press. The riser units may each include a gear box having a screw which pivotally carries an arm with at least one finger assembly thereon which releasably engages a workpiece. The riser units are interconnected by connecting rods so that the arms pivot in unison to grasp and release the matrices of workpieces.

It is an object of the present invention to provide a parts transfer system for moving matrices of workpieces, at least 2×2 in size, through workstations of a press to progressively form a large number of workpieces in a short period of time.

It is another object to provide a press having a workstation wherein a plurality of workpieces are simultaneously stamped from a sheet of material and then arranged into a matrix configuration which is moveable by the parts transfer system between workstations in the press.

A further object is to provide a parts transfer system having an integrated system of riser units which raise and lower matrices of workpieces from and to dies, the riser units being mounted upon a translation base which moves the matrices of workpieces between workstations.

It is still yet another object to provide a parts transfer system having an integrated system of riser units wherein the riser units may be coupled and uncoupled from one another to provide a desired number of riser units which grasp workpieces to be moved through a press.

These and other objects, features and advantages will become readily apparent from the accompanying sheets of drawings and the following description.

BEST MODE FOR CARRYING OUT THE INVENTION

Figure 1:
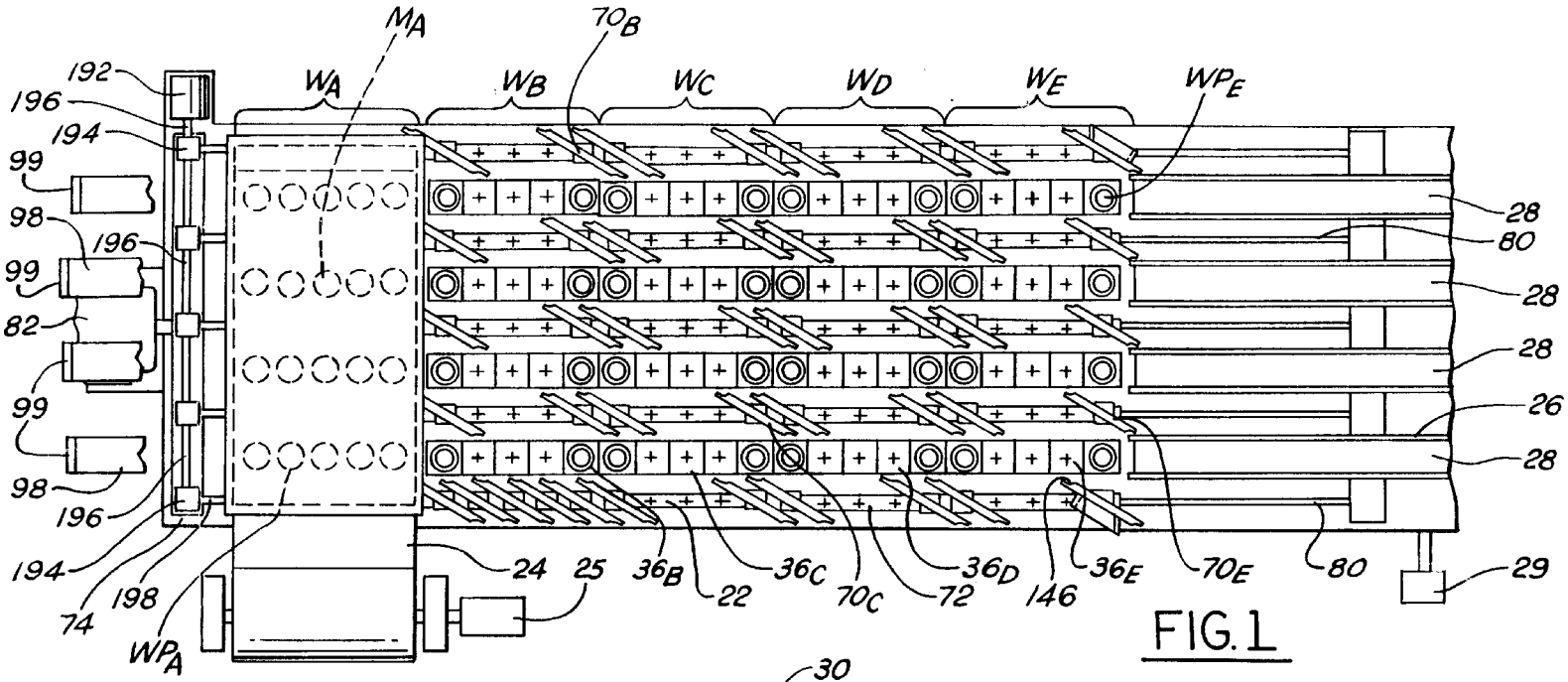
FIG. 1 is a top view of a parts transfer system, interposed among a plurality of lower dies of a press, which progressively moves matrices of workpieces through a plurality of workstations in the press.
Figure 2:
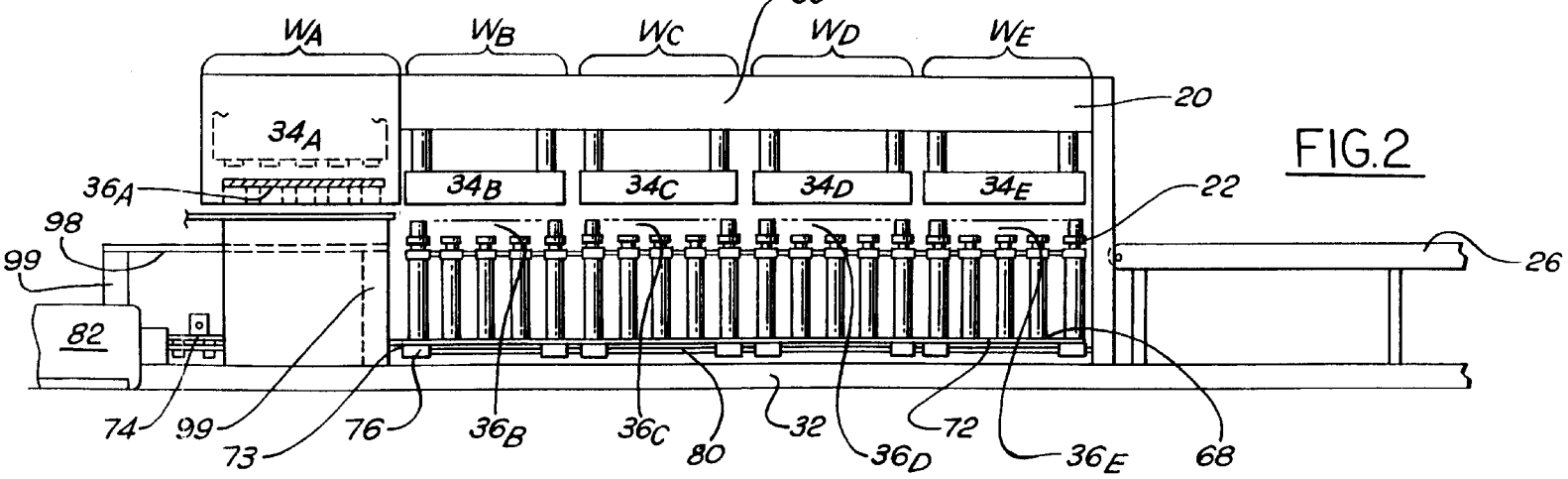
FIG. 2 is a side elevational view of sets of cooperating dies and the parts transfer system made in accordance with the present invention.
Figure 15:
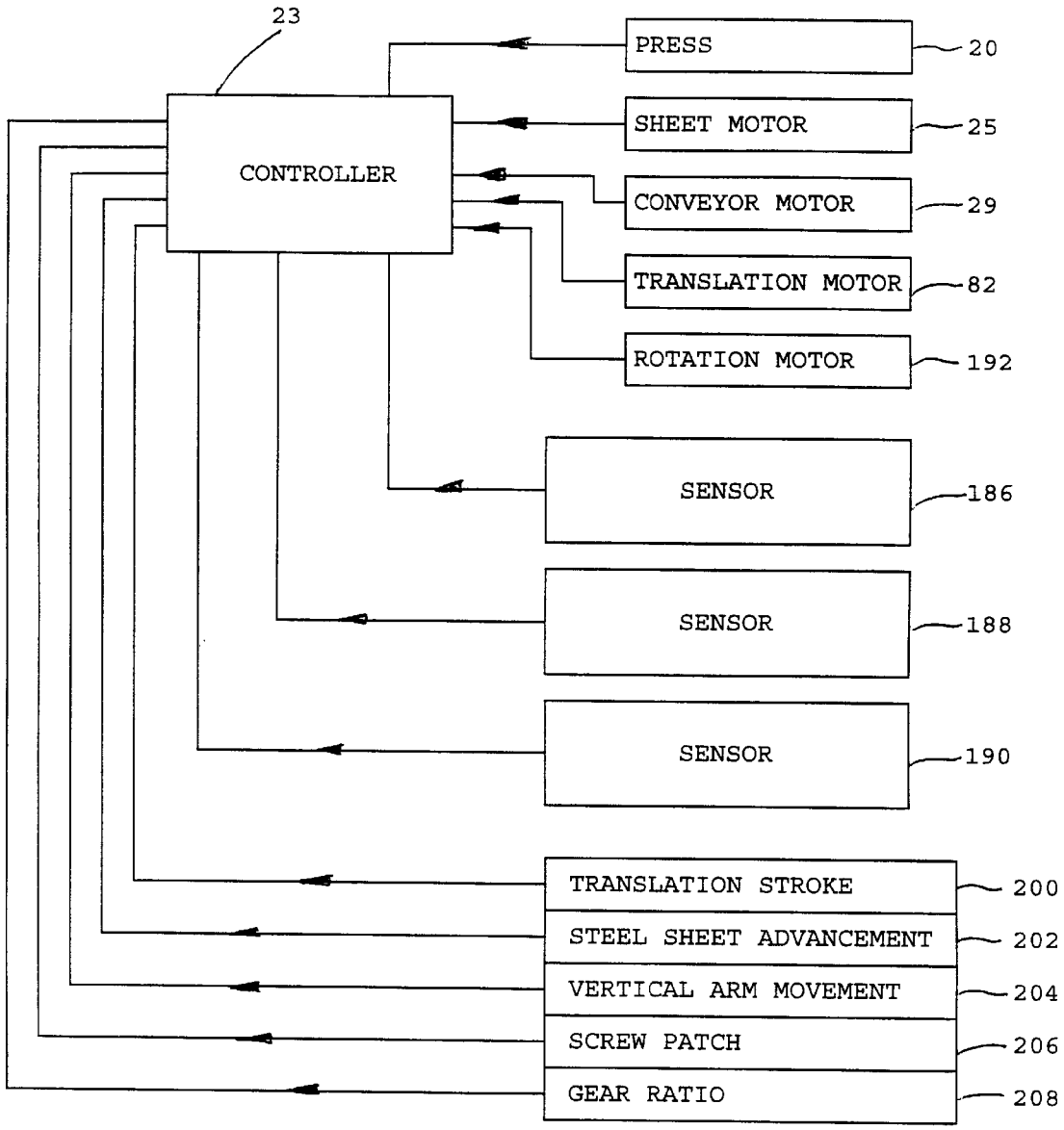
FIG. 15 is a schematic view of the control system controlling the press and parts transfer system.

FIGS. 1 and 2 illustrate a portion of a press 20 and a parts transfer system 22 made in accordance with the present invention. A controller 23, as shown in FIG. 15, is used to control the operation of press 20 and parts transfer system 22.

Press 20, in the preferred embodiment, simultaneously stamps twenty workpieces WP in each of five separate workstations $W_{A-E}$. A workstation W is a region in press 20 wherein stamping or transfer operations on workpieces WP occur. When all of workstations $W_{A-E}$ are filled with workpieces $WP_{A-E}$, a total of 100 workpieces WP are being stamped and formed per stroke of press 20. (Subscripts are used to specify a particular workstation W, the particular workpieces WP formed by the stamping operation in that workstation W and also to designate other components associated with a particular workstation.)

In first workstation $W_A$, 20 blanks or workpieces $WP_A$ are punched from a roll of sheet material 24 which is preferably sheet steel 0.015 inch thick. A motor 25 is used to unroll and advance the roll of sheet steel 24. The 20 blanks are then arranged into a 4×5 matrix $M_A$ of workpieces $WP_A$. For purposes of orientation, matrix $M_A$ is deemed to have four longitudinally extending rows with five laterally or transversely extending columns, as shown in phantom in FIG. 1. Workpieces $WP_A$ travel longitudinally downstream through the remaining four workstations $W_{B-E}$ being progressively formed until a finished product is produced in the fifth workstation $W_E$.

After workpieces $WP_{A-E}$ are stamped in a particular workstation W, parts transfer system 22 grasps and repositions respective matrices $M_{A-D}$ into the next respective downstream workstation $W_{B-E}$. Workpieces $WP_E$, located in the fifth and final stamping workstation $W_E$, are placed upon and transported away from press 20 by a conveyor unit 26. Conveyor unit 26 has four laterally spaced belts 28 and is driven by a conveyor motor 29. Twenty workpieces $WP_E$ are finished per stroke of press 20. In this exemplary and preferred embodiment, a stroke occurs every five seconds thereby producing a total of 14,400 finished parts or workpieces $WP_E$ per hour.

Figure 3:
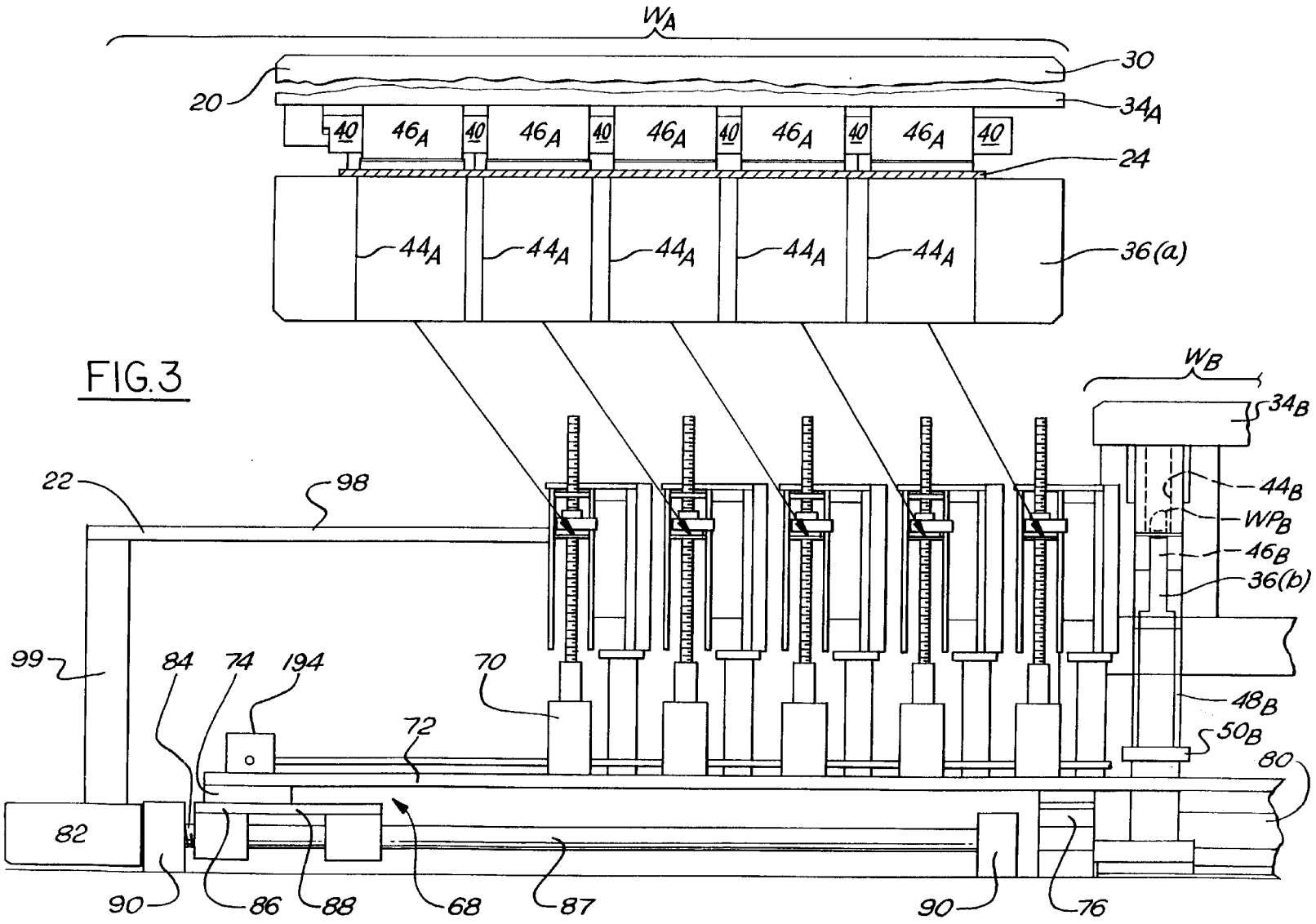
FIG. 3 is a fragmentary side elevational view of a first workstation and part of a second workstation.
Figure 4:
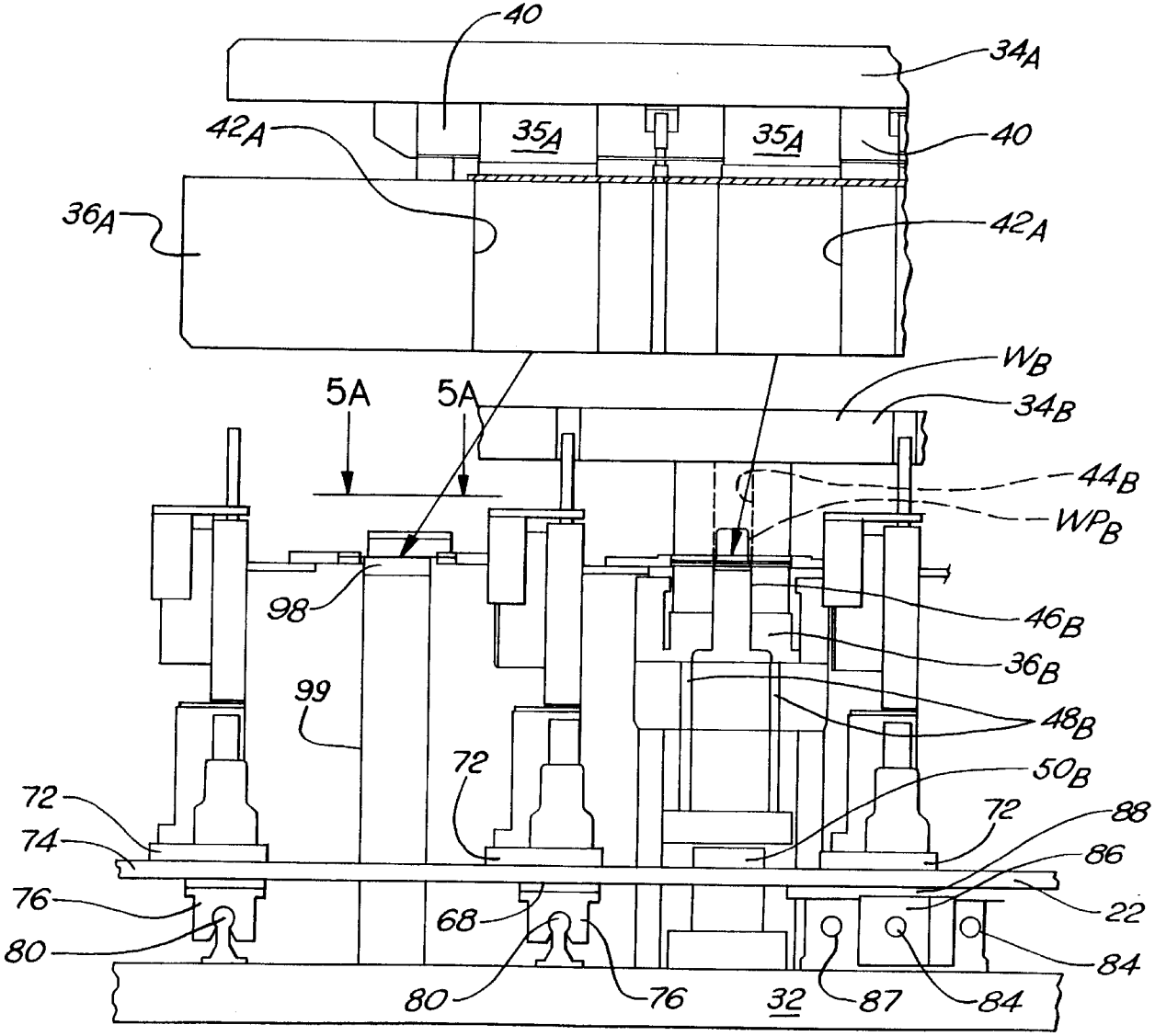
FIG. 4 is a partial fragmentary front elevational view of the first and second workstations.

Referring now to FIGS. 1 and 2, press 20 includes an upper shoe 30 and a lower shoe 32. Five sets of cooperating upper and lower dies $\mathbf{34}_{A-E}$ and $\mathbf{36}_{A-E}$ are attached relative to upper and lower shoes 30 and 32, each set being located in a respective workstation $W_{A-E}$. FIG. 1 is shown without upper shoe 30 and upper dies $\mathbf{34}_{A-E}$ to better illustrate parts transfer system 22 and its relationship to lower dies $\mathbf{36}_{A-E}$. FIG. 2 shows that upper and lower dies $\mathbf{34}_A$ and $\mathbf{36}_A$ are elevated relative to the remaining dies $\mathbf{34}_{B-E}$ and $\mathbf{36}_{B-E}$ FIGS. 3 and 4 illustrate fragmentary portions of first and second workstations $W_A$ and $W_B$. Upper shoe 30 carries upper die $\mathbf{34}_A$ which has twenty punches $\mathbf{46}_A$ extending downwardly. Located adjacent punches $\mathbf{46}_A$ are spring pads 40 which prevent generally planar sheet steel 24, which was previously wrapped in a coil, from curling up. Lower die $\mathbf{36}_A$ has twenty cavities $\mathbf{44}_A$ in registration with the twenty punches $\mathbf{46}_A$ to stamp out twenty blanks or workpieces $WP_A$ from sheet steel 24 each time press 20 is stroked.

Figure 7:
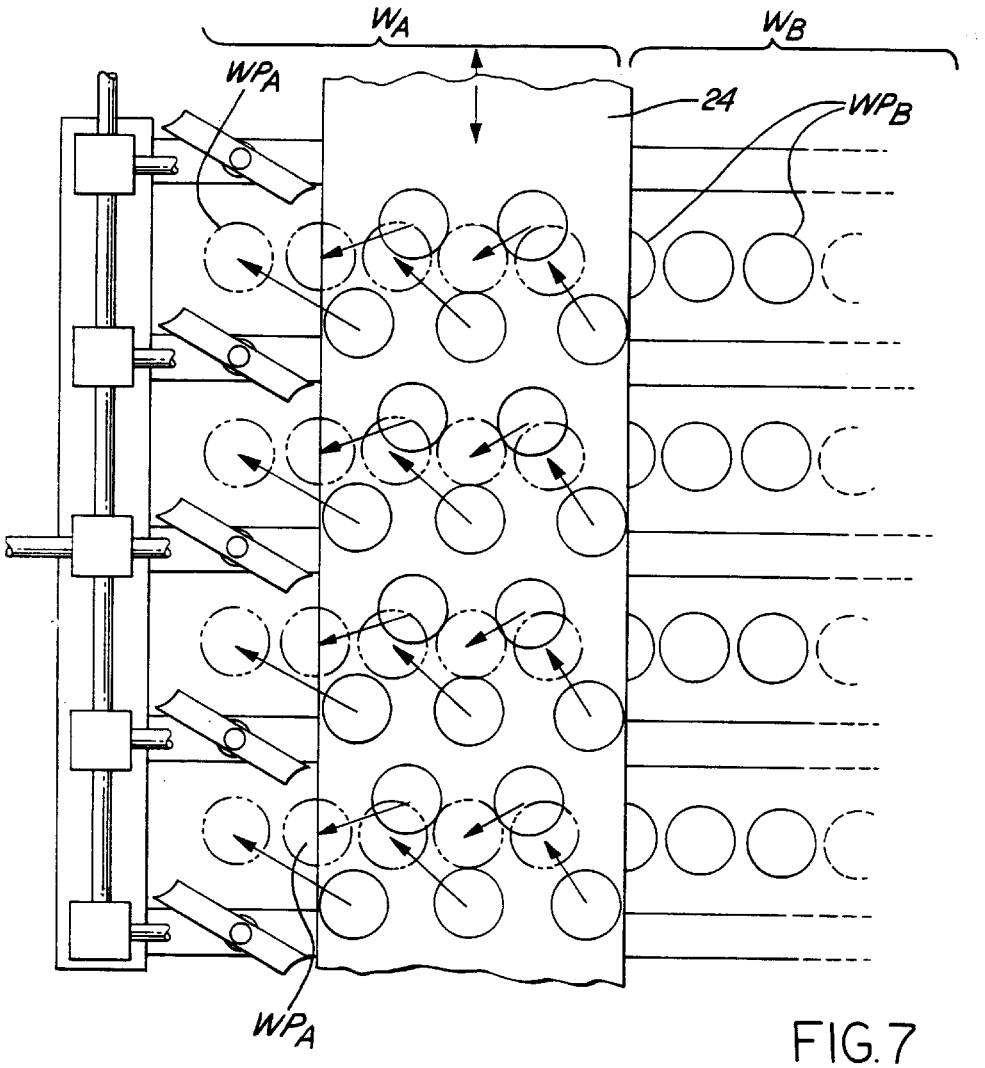
FIG. 7 is a top fragmentary view showing a pattern of twenty blanks which are stamped from a sheet of material and which are arranged into a 4×5 matrix.

After blanks or workpieces $WP_A$ are formed, they are arranged into a 4×5 matrix $M_A$, as indicated by the arrows in FIG. 7. How the stamped blanks are arranged into matrix $M_A$ will be described later. All twenty punches 46, cavities 44 and workpieces WP are all identically configured in each respective workstation $W_{A-E}$ while being differently configured from workstation to workstation to progressively form workpieces WP from blanks in workstation $W_A$ to a finished product in $W_E$.

Located in the second workstation $W_B$ are upper and lower dies $\mathbf{34}_B$ and $\mathbf{36}_B$. In contrast to upper and lower dies $\mathbf{34}_A$ and $\mathbf{36}_A$, upper die $\mathbf{34}_B$ has twenty cavities $\mathbf{44}_B$ and lower die $\mathbf{36}_B$ has twenty upwardly extending punches $\mathbf{46}_B$ which cooperate with one another to draw and form workpieces $WP_A$ into workpieces $WP_B$. Placing a cavity 44 above a punch 46 facilitates trimming operations on a workpiece WP. For simplicity and clarity, only one of the twenty cooperating pairs of cavities $\mathbf{44}_B$ and punches $\mathbf{46}_B$, is shown in FIGS. 3 and 4. However, it should be appreciated that each workstation $W_{B-E}$ has 4×5 matrices of cavities 44 and punches 46 located therein.

Punches $\mathbf{46}_B$ are located atop transfer pins $\mathbf{48}_B$ and nitrogen cylinders $\mathbf{49}_B$. Nitrogen cylinders $\mathbf{49}_B$ bias punches $\mathbf{46}_B$ upwardly while providing cushioning when punches $\mathbf{46}_B$ stamp workpieces $WP_B$ into cavities $\mathbf{44}_B$. Workstations $W_{C-E}$ similarly have upper and lower dies $\mathbf{34}_{C-E}$ and $\mathbf{36}_{C-E}$ which have cavities $\mathbf{44}_{C-E}$ and punches $\mathbf{46}_{C-E}$. Upper and lower dies $\mathbf{34}_{C-E}$ and $\mathbf{36}_{C-E}$ are generally similar in configuration to upper and lower dies $\mathbf{34}_B$ and $\mathbf{36}_B$ with the exception that punches $\mathbf{46}_{C-E}$ and cavities $\mathbf{44}_{C-E}$ are appropriately sized and configured to continue the progressive drawing and forming of workpieces $WP_{C-E}$. As all of upper and lower dies $\mathbf{34}_{A-E}$ and $\mathbf{36}_{A-E}$ are affixed relative to respective upper shoe 30 and lower shoe 32, the drawing and forming of workpieces $WP_{A-E}$ occur simultaneously during a single stroke of press 20.

Figure 8:
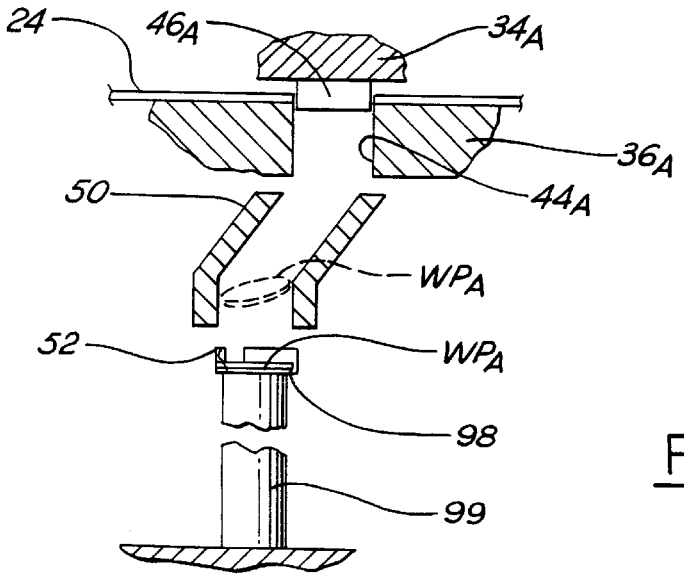
FIG. 8 is an exemplary schematic view of a workpiece being stamped in a pair of dies and falling within the chute.

FIG. 8 schematically shows a workpiece $WP_A$ being stamped from sheet 24. Punch $46_A$ is received within cavity $44_A$ shearing workpiece $WP_A$ from sheet 24. After falling through lower die $36_A$, workpiece $WP_A$ is received in and passes through a chute 50 and is collected in a positioning gage 52.

FIG. 7 schematically illustrates that the twenty workpieces $WP_A$ punched from sheet 24 will fall through twenty respective chutes 50 to be positioned within twenty workpieces 52. The positioning gages 52 and workpiece $WP_A$ located in positioning gages 52 are thereby arranged into the 4×5 matrix $M_A$.

Figure 9:
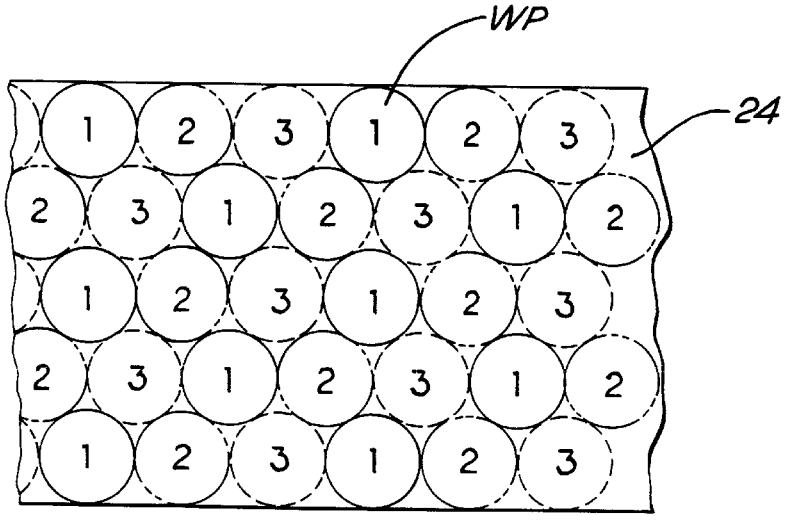
FIG. 9 is a schematic view showing the order in which successive patterns of blanks are cut from the sheet of material.

The majority of sheet 24 is utilized in forming workpieces $WP_A$. In FIG. 9, the circles designated with the numeral 1 indicate those workpieces $WP_A$ cut in a first stroke of press 20. Similarly, circles enumerated with numerals 2 and 3, respectively, indicate workpieces $WP_A$ cut in the next two strokes of the press 20. Motor 25 appropriately advances sheet 24 with each stroke of press 20 to effect the cut-out pattern shown in FIG. 9. After the cycle of three strokes, which cuts the three sets of workpieces $WP_A$, has occurred, sheet 24 is advanced sufficiently to place a new uncut segment of sheet 24 into workstation $W_A$ so another three sets of workpieces $WP_A$ may be cut therefrom.

Figure 6:
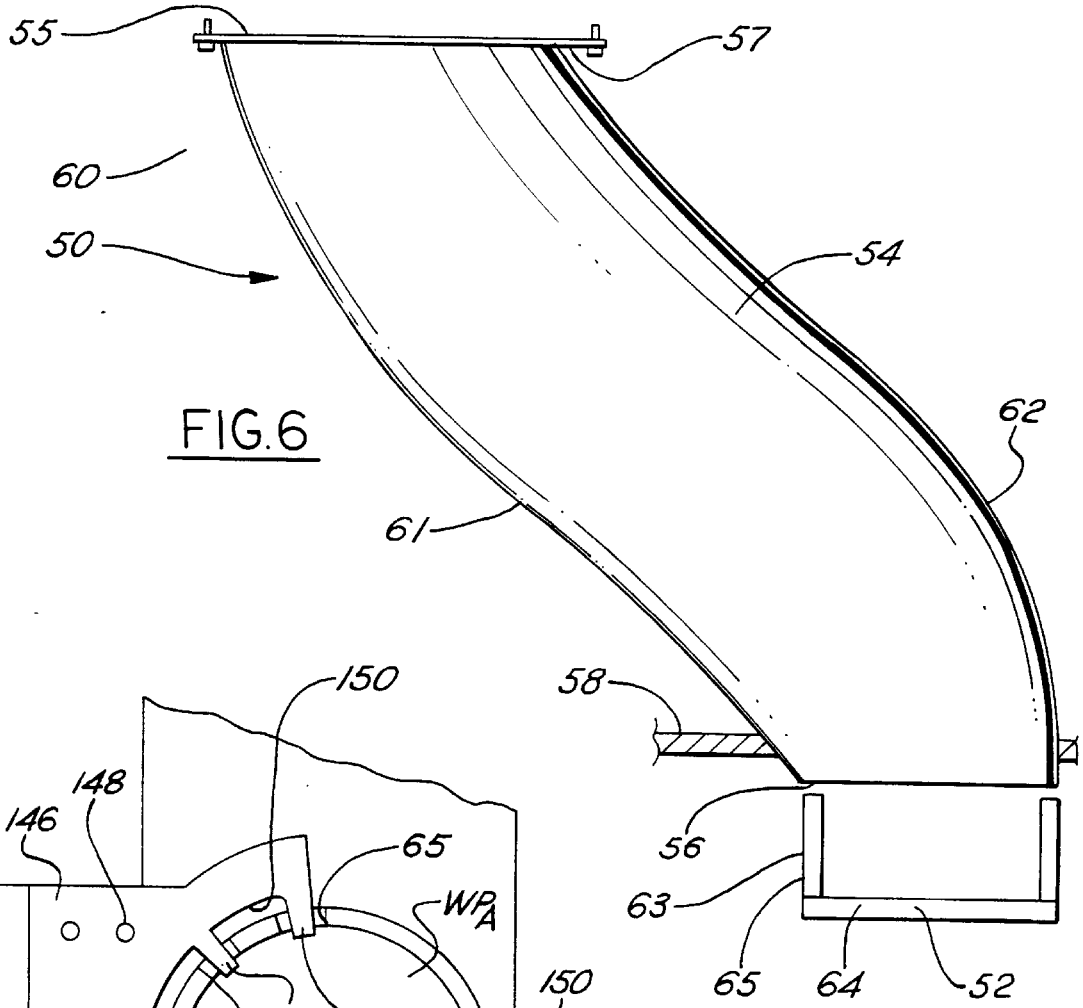
FIG. 6 is a side elevational view of a chute which attaches to a die and through which a blank falls to be positioned within a gage.

Turning now to FIG. 6, an exemplary chute 50 is shown in greater detail. Chute 50 includes an S-shaped body 54, upper and lower openings 55 and 56, and brackets 57 and 58. Bracket 57 is secured to body 54 adjacent upper opening 55 and is affixable by screws in tapped holes (not shown) in lower die $36_A$. Bracket 58 is secured to body 54 proximate lower opening 56 and also secures to other bodies 54 of other chutes 50. When all of chutes 50 are installed, brackets 58 interconnect the lower ends of bodies 54 to provide structural rigidity to the plurality of chutes 50.

In the preferred embodiment, workpieces $WP_A$ are 5½ inches in diameter. To easily receive workpieces $WP_A$ into chute 50, upper opening 55 is 8 inches in diameter. As shown, body 54 includes an upper arcuate portion 60, a straight portion 61 and a lower arcuate portion 62. Portions 60 and 61 of body 54 remain 8 inches in diameter. However, lower arcuate portion 62 narrows from the 8 inches to 6 inches in diameter at lower opening 56. The overall height of chute 50 is 17 inches. Of course, the above described dimensions are only exemplary and other combinations of dimensions can be used with different sized blanks or workpieces $WP_A$.

Figure 5A:
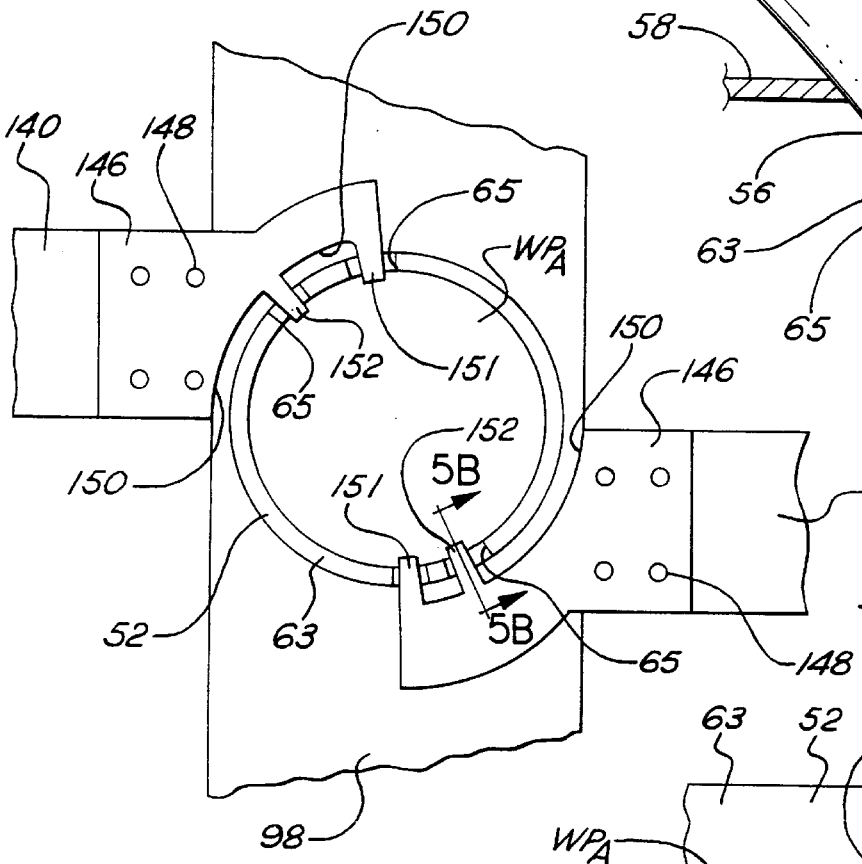
FIG. 5A is a fragmentary top view, taken along line 5A—5A, of FIG. 4 showing a pair of finger assemblies cooperatively grasping a blank or workpiece.
Figure 5B:
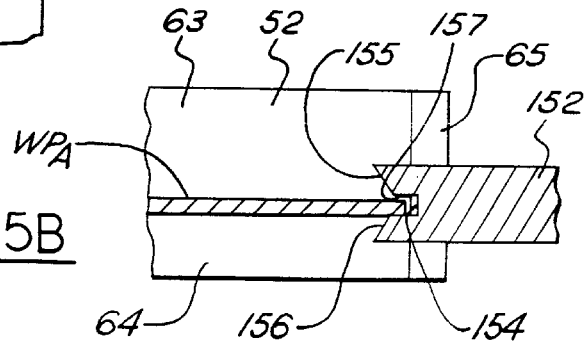
FIG. 5B is a fragmentary sectional view taken along line 5B—5B of FIG. 5A of a blank positioned within a gage and a finger assembly.

Looking now to FIGS. 5A, 5B and FIG. 6, positioning gage 52 is can-like having a cylindrical wall 63 and a base 64. Two pairs of circumferentially spaced slots 65 extend vertically through wall 63 and base 64. As will be described later, these slots 65 provide access to a lifting mechanism of parts transfer system 22. The inner diameter of positioning gage 52 is 6 inches. Therefore, when a 5½ inch blank falls within positioning gage 52, it will flushly rest atop base 64. As shown in FIG. 6, a gap exists between gage 52 and chute 52.

Parts transfer system 22 provides two components of movement to matrices $M_{A-E}$ of workpieces $WP_{A-E}$, longitudinal and vertical. In order to effect longitudinal movement, a translation base 68 is moved upstream and downstream relative to press 20 and dies $34_{A-E}$ and $36_{A-E}$. Mounted atop translation base 68 is a grasping unit 69 having an integrated system of riser units 70 which grasp and raise and lower individual workpieces WP from positioning gages 52 and lower dies $36_{B-E}$. In combination, translation base 68 and grasping unit 69 cooperate to move matrices $M_{A-E}$ through press 20.

Figure 10:
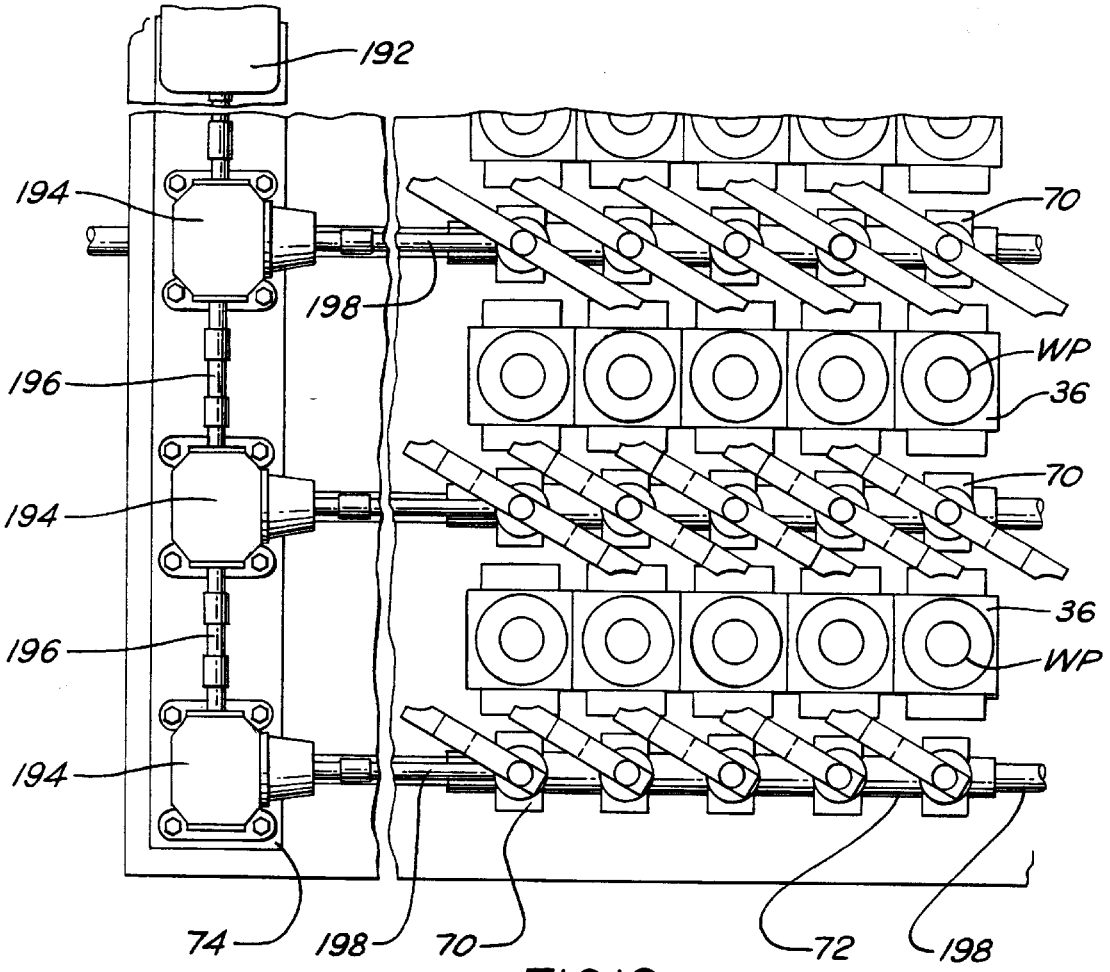
FIG. 10 is a partial fragmentary top view of riser units in retracted positions adjacent rows of workpieces resting upon a lower die.

As indicated in FIG. 1, parts transfer system 22 includes five sets of 5×5 matrices of riser units 70 for a total of 125 riser units. The five laterally spaced rows of riser units $70_{A-E}$ sandwich the four rows of workpieces $WP_{A-E}$ extending the length of workstations $W_{A-E}$. Two laterally spaced riser units 70 cooperate with one another to grasp, lift, lower and release an individual workpiece WP. The fragmentary view in FIG. 10 illustrates three rows of riser units 70 flanking two rows of workpieces WP.

Referring now to FIGS. 3, 4 and 7 translation base 68 includes five laterally spaced transport beams 72 and a header beam 74. Each row of riser units 70 in each 5×5 matrix M is carried by one of the five laterally spaced and longitudinally extending transport beams 72. Laterally extending header beam 74 connects together the upstream ends of transport beams 72. Accordingly, all five of the transport beams 72 and 125 riser units 70 supported thereon translate longitudinally in unison.

Each transport beam 72 is supported by a plurality of longitudinally spaced pillow blocks 76 which respectively slide upon one of five laterally spaced and longitudinally extending rails 80 located beneath respective transport beams 72. FIG. 4 shows a cross-section of a pair of the pillow blocks 76 and rails 80. Pillow blocks 76 and rails 80 are model 1CA-24-H40-L48 available from Thompson Industries of Port Washington, N.Y.

To effect movement of translation base 68, a translation motor 82 turns a screw 84 of a slide unit 86. As shown in FIG. 3 and 4, slide unit 86 includes screw 84, a pair of shafts 87 laterally flanking screw 84, a carriage 88 slidably mounted on shafts 87 and threadedly mounted on screw 84, and a pair of longitudinally spaced pillow blocks 90 which journal the ends of screw 84 and shafts 87. Header beam 74 is carried by carriage 88. Translation motor 82 is reversible and by rotating screw 84 forwards and backwards, translation base 68 and grasping unit 69 are moved longitudinally between adjacent workstations W. In this exemplary embodiment, slide unit 86 is a Thompson Superslide model 2EB-24-ftd-J-L64, also manufactured by Thompson Industries. Translation motor 82 is preferably a 7.5 horsepower, HR2000 Series, model P21M303 motor made by Reliance Electric of Cleveland, Ohio.

Rails 80 and pillow blocks 76 slidably support transport beams 72. The non-center four rails 80 extend the length of parts transfer system 22. However, the remaining middle rail 80 does, not extend into workstation $W_A$. Rather, slide unit 86 takes its place in workstation $W_A$ with the upstream end of transport beam 72 being supported by header beam 74.

Looking to FIGS. 1 and 3, extending the length of workstation $W_A$ are four longitudinally extending planks 98 located between rows of riser units $70_A$. Longitudinally spaced vertical posts 99 are located at each of the ends of planks 98 and are attached to lower shoe 32.

FIG. 4 shows a vertical post 99, secured to lower shoe 32, which supports an end of a longitudinally extending plank 98. The adjacent set of vertical posts 99 and planks 98 in FIG. 4 have been removed to better display a lower die $36_B$ in workstation $W_B$. Located atop each of the four planks 98 are five longitudinally spaced positioning gages 52.

A typical riser unit 70 is shown in FIGS. 11–14. Riser unit 70 includes a miter gear box assembly 110 which has an upwardly extending vertical screw 112, an input shaft 114 and an output shaft 116. Rotation of input shaft 114 causes rotation of screw 112 and output shaft 116. As will be described later, all 125 miter gear boxes 110 are tied together so that all of screws 112 will rotate identically together.

Miter gear box assembly 110 is preferably model GB200, type E available from Nook Industries of Cleveland, Ohio.

A clutch 118 attaches an inverted U-shaped guide assembly 120 to screw 112. Guide assembly 120 has a pair of vertically downwardly extending guide plates 122 connected at their upper ends by a block 124 which contains a smooth hole through which screw 112 passes. Clutch 118 has upper and lower disks 126 and 128 affixed to screw 112 and sliding pads 130 and 132 which sandwich about block 124. Sliding pads 130 and 132 are slidable relative to fixed disks 126 and 128 to allow screw 112 to rotate relative to guide assembly 120. The compression of sliding pads 130 and 132 between disks 126 and 128 is adjustable by a compression nut 134 to alter the torque needed to rotate guide assembly 120 relative to screw 112. Clutch 118 is preferably model 250A-2, which has a ¾" bore and a 0.540 " bushing, and is produced and sold by Morse Industries of Ithica, N.Y.

A horizontally extending arm 140 is affixed to a boss 142 which is threadedly mounted on screw 112. Accordingly, when screw 112 rotates relative to arm 140 and threaded boss 142, arm 140 is raised or lowered, depending on the direction of rotation of screw 112. Arm 140 pivots with guide plates 122 and slides vertically therebetween.

Attached at either end of arm 140 is a finger assembly 146 which is configured to cooperate with an opposing finger assembly 146 to grasp a workpiece WP. Screws or bolts are used as fasteners 148 to releasably attach a finger assembly 146 to an arm 140.

An exemplary pair of cooperating finger assemblies 146 are shown in FIGS. 5A and 5B grasping a workpiece $WP_A$ which is located in a positioning gage 52 in workstation $W_A$. Each finger assembly 146 has an arcuate inner surface 150 which has a pair of inwardly extending prongs 151 and 152 which extend radially inwardly through slots 65 in positioning gage 52 when arms 140 are in extended positions.

At the end of each prong 151 and 152 is a bell-mouthed aperture 154 which includes opposing beveled surfaces 155 and 156 and slot 157. Beveled surfaces 155 and 156 assist in positioning the radial edges of workpiece $WP_A$ within apertures 154. The combination of circumferentially spaced prongs 151 and 152 on the pairs of cooperating finger assemblies 146 securely holds a workpiece $WP_A$ so that it may be lifted from positioning gage 52 or from a lower die $36_{B-E}$.

Returning to FIGS. 11–14, located rearwardly of riser unit 70 is a stop assembly 160 including a lower support plate 162, an upper support plate 164, a transverse plate 166, and a height regulator plate 168. Lower support plate 162 is secured to a transport beam 72. Upper support plate 164 is connected atop lower support plate 162 and at its top end supports a first end of transverse plate 166 which extends generally upstream or forwardly. Cantilevered from the second end of transverse plate 166 is downwardly depending height regulator plate 168.

Also, attached to upper support plate 164 is a vertically extending retract stop plate 170 which has a common vertical edge with upper support plate 164 and is aligned to have a stop face 174 which flushly mates with a vertical edge of arm 140 when arm 140 is in fully retracted position. This fully retracted position is shown in phantom in FIG. 11.

Figure 11:
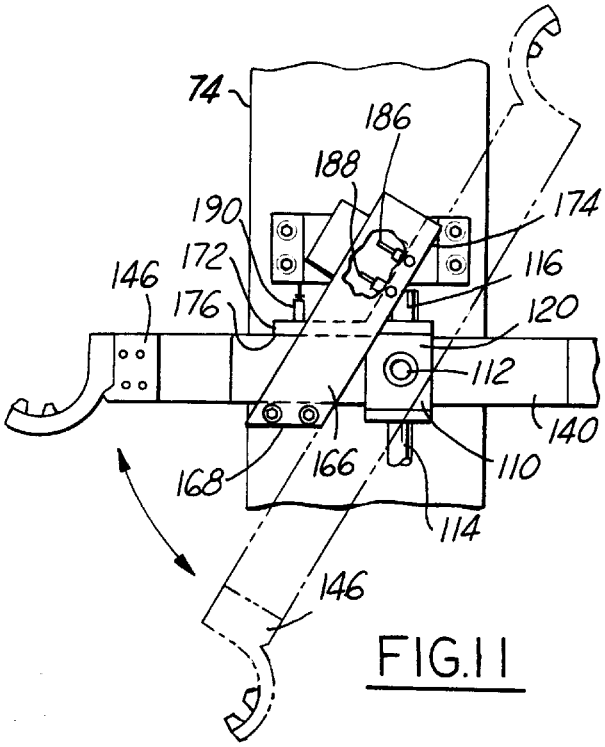
FIG. 11 a top view of a riser unit with an arm in an active or extended position and, in phantom, the arm in a retracted position.
Figure 14:
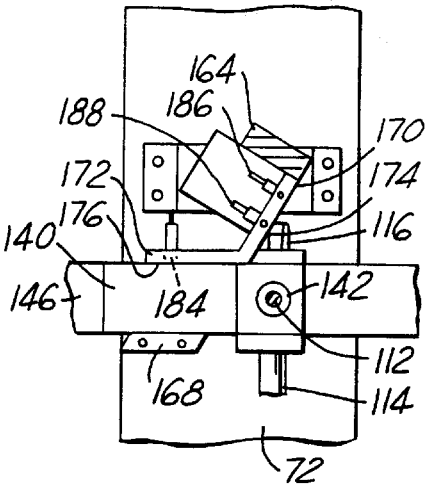
FIG. 14 is a sectional view taken along line 14—14 of FIG. 12.

Extending from the other vertical edge of retract stop plate 170 is extend stop plate 172 which has a stop face 176 which flushly mates with the other vertical edge of arm 140 when arm 140 is in a fully extended or operative position grasping a workpiece WP. As seen in FIG. 11, arm 140 extends perpendicular to transport beam 72 when in the fully extended position. Accordingly, stop face 176 is also aligned perpendicular to transport beam 72.

Located in retract stop plate 170 and extend stop plate 172 are two and one respective apertures 180, 182 and 184 receiving sensors 186, 188 and 190 therein. Sensors 186, 188 and 190 emit and receive electromagnetic waves which are bounced off of arm 140 when arm 140 is positioned in front of one of the sensors 186, 188 or 190. Sensors 186, 188 and 190 are electrically connected to controller 23. In this preferred embodiment, sensors 186, 188 and 190 are model IFA 2002-FRKG manufactured by IFM Electronics of Exton, Pa.

To establish a baseline or zero height of arm 140, arm 140 is raised above the lowest sensor 186 and then lowered until sensor 186 is triggered. This is accomplished by appropriately rotating screw 112 of miter gear box assembly 110. A signal from sensor 186 is then sent to controller 23 signifying that arm 140 is at its baseline or zero height.

Next, to grasp a workpiece WP, screw 112, guide assembly 120 and arm 140 are pivoted clockwise (as seen in FIG. 11) until finger assembly 146 engages workpiece WP or else arm 140 strikes stop face 176 on extend stop plate 172. Arm 140 clears the bottom edge of height regulator plate 168 in engaging workpiece WP.

Figure 12:
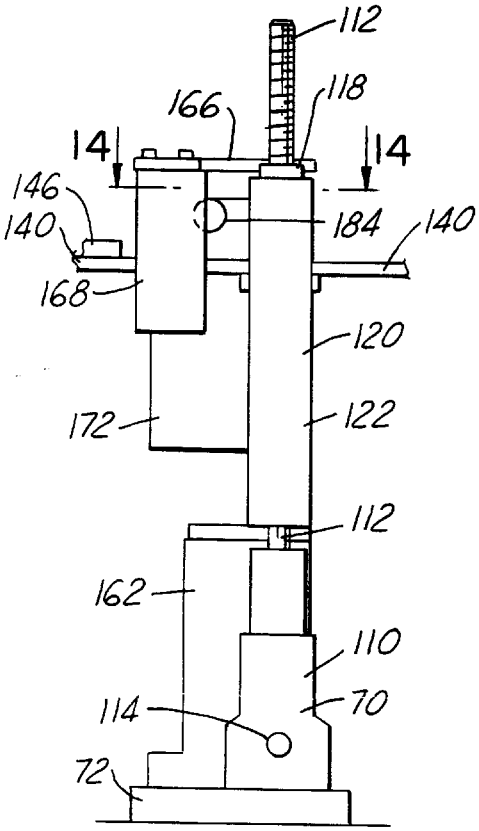
FIG. 12 is a front elevational view of the riser unit of FIG. 11.
Figure 13:
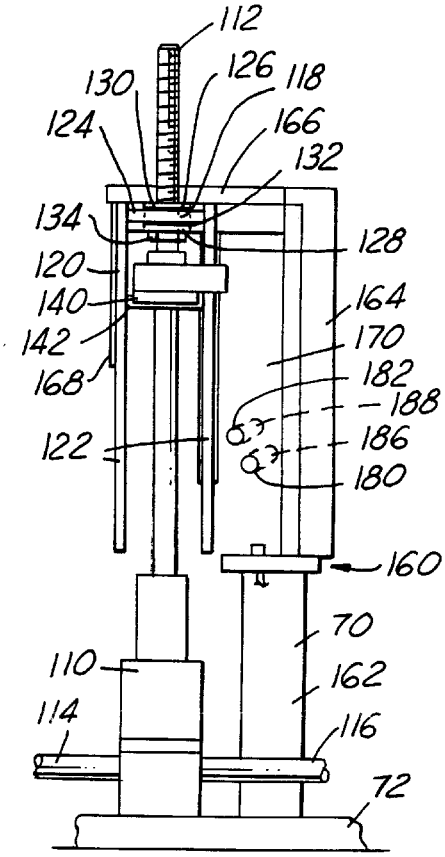
FIG. 13 is a side elevational view of the riser unit of FIG. 11.

At this point, the frictional engagement between disks 126 and 128 and sliding pads 130 and 132 of detent 118 is overcome as screw 112 rotates. Screw 112 turns relative to block 124 and arm 140 thereby lifting arm 140 and workpiece WP vertically. As seen in FIG. 12, arm 140 moves vertically between extend stop plate 172 and height regulator plate 168. Arm 140 continues to be lifted as screw 112 rotates a predetermined number of revolutions, which is controlled by controller 23. This lifts workpiece WP clear of positioning gage 52 on a lower die $36_{B-E}$ Riser unit 70 and workpiece WP are then moved by translation base 68 downstream to an adjacent workstation W or else to conveyor unit 26. This is accomplished by controller 23 activating motor 82 which rotates screw 84 and moves translation base 68 carrying riser units 70.

Upon reaching the next workstation, workpiece WP is placed upon a punch 46 of a lower die 36 or else belt 28 of conveyor unit 26. To accomplish this, screw 112 is rotated counterclockwise (as seen in FIG. 11) to lower arm 140. Height regulator plate 168 abuts arm 140 and prevents significant rotation of arm 140. Rotational movement of arm 140 between stop face 176 of extend stop member 172 and height regulator plate 168 is toleranced and limited such that workpiece WP is held within cooperating slots 157 of finger assemblies 146. When arm 140 clears the bottom edge of height regulator plate 168, workpiece WP will have been sufficiently lowered to reside upon a lower die 36 or conveyor unit 26.

Once free of height regulator plate 168, arm 140 couples with clutch 118 to rotate and retract with screw 112 until abutting stop face 174. Screw 112 then again rotates relative to arm 140 a predetermined number of revolutions to lower arm 140. Controller 23 then returns translation base 168 to its upstream position.

Arm 140 triggers sensor 186 only during start up or when part transfer system 22 needs to be reinitialized. Sensors 188 and 190 are used only as safety devices to override controller 23 when arm 140 moves outside of its normal vertical operational range.

The 125 riser units 70 are integrated to raise and lower arms 140 simultaneously. FIGS. 1 and 10 show a rotation motor 192 which simultaneously controls the rotation of all 125 riser units 70. (Stop assemblies 160 are not shown in FIGS. 1 and 10 to simplify the drawings). Gear boxes 194 reside upon header beam 74 and are aligned with each of the five rows of riser units 70. Traversely connecting rotation motor 192 with gear boxes 194 are connecting rods 196. Longitudinally connecting each gear box 194 and its row of miter gear box assemblies 110 are connecting rods 198 joining respective input and output shafts 114 and 116 of adjacent gear boxes 194 and 110. All 125 miter gear box assemblies 110 lower and raise their arms 140 in unison in response to the rotation motor 192. Note that connecting rods 198 can be disconnected from selected miter gear box assemblies 110 to change the size of matrices M, for example, from a 4×5 matrices to a 3×5 matrices.

As miter gear box assemblies 110 are all interconnected, only one riser unit 70 and its associated stop assembly 160 require a set of sensors 186, 188 and 190 to monitor the operation of all 125 riser units 70. The single riser unit 70 and stop assembly 160 having sensors 186, 188 and 190 may be positioned anywhere in the matrices of riser units 70. In this exemplary embodiment, the sensors 186, 188 and 190 may be located on the stop assembly 160 at the upstream most end of workstation $W_A$ on the center row of riser units 110 (not shown).

FIG. 15 is a schematic view of the control system operating press 20 and parts transfer system 22. The controller 23 is used to control the operation of press 20 and parts transfer system 22.

Controller 23 receives inputs from the three sensors 186, 188 and 190 and from a variety of operator input parameters 200, 202, 204, 206 and 208. Parameter 200 is the desired translation stroke of header beam 74 or the length of movement of translation base 68 between adjacent workstations W. Parameter 202 is the amount of advancement the roll of steel is to be given, which is related to the diameter of a blank or workpiece $WP_A$. Parameter 204 is the amount of operable vertical range that each arm 140 travels through. Parameter 206 and 208 include the pitch of screw 84 and the gear ratio between motor 192 and screw 112.

Controller 23 outputs signals to motors 25, 29, 82 and 192, respectively, to control the feeding of sheet metal 24, the operation of conveyor unit 26, the translation of translation base 68 and the rotation of screws 112. Controller 23 also controls the stroking of press 20. Other parameters of the press, such as the spray of oil to cool components such as dies 34 and 36 and safety related mechanisms can also be controlled by controller 23.

In operation, parameters 200, 202, 204, 206 and 208 are input to controller 23. Next, the height of arms 140 are baselined by lowering arms 140 until sensor 186 is triggered. Controller 23 operates motor 25 to advance sheet steel 24 until it is appropriately located between upper and lower dies $34_A$ and $36_A$. Press 20 is fired stamping out twenty blank workpieces $W_A$ with upper die 34 returning to its up position. Workpieces $W_A$ fall through chutes 50 and are positioned on rail 98 in positioning gages 52 into the 4×5 matrix $M_A$.

Controller 23 next causes rotation motor 192 to rotate connecting rods 196 and 198 and screws 112 with arms 140 pivoting into extended positions. Arms 140 adjacent workstation $W_A$ grasp workpieces $WP_A$. Arms 140 in workstations $W_{B-E}$ rotate into extended positions until striking extend stop plate 172. All arms 140 then elevate as screws 112 rotate through a predetermined number of revolutions which is calculated and controlled by controller 23. The matrix $M_A$ of workpieces $WP_A$ is thereby lifted by arms $140_A$ and finger assemblies $146_A$.

Controller 23 then causes translation motor 82 to rotate sufficient revolutions so that grasping unit 69 holding workpieces $W_A$ are translated downstream and aligned adjacent lower die $36_B$. Rotation motor 192 is reversed lowering workpieces $W_A$ on to lower die $36_B$ of workstation $W_B$. Arms 140 continue to lower until clearing height regulator plate 168 and releasing workpieces $W_A$. Arms 140 continue to rotate until they are in a fully retracted position abutting against retract stop plate 170.

Translation motor 82 is then reversed moving translation base 68 and riser units $70_A$ upstream adjacent workstation $W_A$. Meanwhile, sheet steel 24 is advanced so that a second set of blanks may be stamped therefrom as indicated in FIG. 9.

Press 20 is again fired with 20 new blanks or workpieces $WP_A$ being stamped and matrix $M_A$ of workpieces $WP_A$, now located in workstation $W_B$, being further formed by upper and lower dies $34_B$ and $36_B$ into workpieces $WP_B$. This above-described cyclic operation is continued with all workstations $W_{A-E}$ eventually being filled and finished products $WP_E$ being carried away by conveyor unit 26.

Sensors 188 and 190 are positioned above and below the normal vertical range of operational movement of arms 140. In the event arms 140 accidentally travel outside this normal operational range, sensors 188 and 190 are triggered with controller 23 shutting down press 20 and parts transfer system 22.

While in the foregoing specification this invention has been described in relation to a certain preferred embodiment thereof, and many details have been set forth for the purpose of illustration, it will be apparent to those skilled in the art that the invention is susceptible to alteration and that certain other details described herein can vary considerably without departing from the basic principles of the invention. For example, the finger assemblies 146 of riser units 70 could be configured differently to grasp various shapes of workpieces WP.

What is claimed is:

1. A workpiece forming apparatus for use in a strokable press to progressively form workpieces from a sheet of material, the apparatus comprising:

a cutting set of dies affixable to the press which cut a plurality of workpieces from a sheet of material when the press is stroked;

a first set of forming dies affixable to the press which forms the workpieces when the press is stroked;

a second set of forming dies affixable to the press which further forms the workpieces initially formed by the first set of forming dies when the press is stroked; and a parts transfer mechanism located in the press for transferring a matrix of workpieces from the cutting set of dies to the first set of forming dies and then from the first set of forming dies to the second set of forming dies between successive strokes of the press, the parts transfer mechanism including an integrated system of riser units which releasably grasps the workpieces to transfer them;

whereby the sheet of material may be introduced to the cutting set of dies with a plurality of workpieces being cut from the sheet of material and then the plurality of workpieces are progressively transferred to and formed by the respective first and second sets of forming dies such that only a single press is required to transform a sheet of material into a plurality of formed workpieces.

2. The apparatus of claim 1 wherein:

the chutes have upper openings and lower openings, the upper openings of the plurality of chutes being arranged in a non-matrix configuration and the lower openings being arranged in a matrix configuration so that workpieces passing through the chutes become arranged into a matrix configuration such that a grasping unit can grasp the matrix of workpieces arranged by the chutes.

3. The apparatus of claim 1 wherein:

the arranging mechanism includes a plurality of chutes through which the workpieces fall.

4. The apparatus of claim 1 wherein:

the arranging mechanism arranges the workpieces into a matrix configuration having at least two rows and two columns.

5. The apparatus of claim 1 wherein:

the parts tranfer mechanism includes an arranging mechanism for receiving a plurality of workpieces from the cutting set of dies and for arranging the workpieces into a matrix configuration prior to transferring the plurality of workpieces to the first set of forming dies.

6. The apparatus of claim 1 wherein:

the riser units are connectable and disconnectable from one another to provide a desired number of riser units.

* * * * *